United States Patent [19]

Kaneko

[11] Patent Number: 4,958,827

[45] Date of Patent: Sep. 25, 1990

[54] SHEET EJECTOR

[75] Inventor: Tamaki Kaneko, Fujisawa, Japan

[73] Assignee: Ricoh Company, Ltd., Tokyo, Japan

[21] Appl. No.: 403,851

[22] Filed: Sep. 5, 1989

Related U.S. Application Data

[63] Continuation of Ser. No. 31,463, Mar. 30, 1987, abandoned.

[30] Foreign Application Priority Data

Aug. 20, 1986 [JP] Japan ..... 61-194156
Aug. 20, 1986 [JP] Japan ..... 61-194157
Sep. 5, 1986 [JP] Japan ..... 61-209249

[51] Int. Cl.[5] ..... B65H 29/22

[52] U.S. Cl. ..... 271/176; 271/81; 271/201

[58] Field of Search ..... 271/201, 81, 314, 176, 271/189, 200

[56] References Cited

U.S. PATENT DOCUMENTS 591,223 10/1897 North ..... 271/81
1,464,513 8/1923 Sutherland ..... 271/81
1,958,133 5/1934 DeLang ..... 271/201
3,030,107 4/1962 Stidwell ..... 271/201 X
3,687,446 8/1972 Neumann ..... 271/201 X
4,127,264 11/1978 Fayolle ..... 271/201 X
4,548,403 10/1985 Matsui ..... 271/296
4,580,774 4/1986 Yamaguchi ..... 271/81 X
4,678,180 7/1987 Tamura ..... 271/296

FOREIGN PATENT DOCUMENTS 1127915 4/1962 Fed. Rep. of Germany ..... 271/201
6872 1/1983 Japan ..... 271/201
724100 2/1955 United Kingdom ..... 271/191

*Primary Examiner*—Richard A. Schacher
*Attorney, Agent, or Firm*—Oblon, Spivak, McClelland, Maier & Neustadt

[57] ABSTRACT

A sheet ejector for transporting sheets discharged from a sheet handling apparatus such as electronic copying machine or facsimile machine to a sheet tray is disclosed. The sheet discharged from the sheet handling apparatus is pinched by a movable member which is moved to the sheet tray to transport the sheet therewith and to eject the sheet to the sheet tray.

5 Claims, 19 Drawing Sheets

SHEET EJECTOR

This application is a Continuation of application Ser. No. 07/031,463, filed on Mar. 30, 1987, now abandoned.

FIELD OF THE INVENTION

The present invention relates to a sheet ejector for use in a sheet handling apparatus such as electronic copying machine and printer etc. for transporting sheets such as paper sheets ejected from the sheet handling apparatus to a sheet tray.

RELATED ART STATEMENT

A sheet ejector which comprises a pair of sheet ejecting rolls arranged in the vicinity of a sheet ejecting port of the sheet handling apparatus and in which sheets ejected therefrom are carried by the sheet ejecting rolls onto a sheet tray has been known.

In such conventional sheet ejector, the ejecting rolls are fixedly arranged in places and, therefore, it is impossible to stack a plurality of sheets ejected in succession from the sheet handling apparatus on the sheet tray in registered manner. Particularly, when the size of ejected sheets is various, the above tendency is enhanced.

OBJECT AND SUMMARY OF THE INVENTION

The present invention was made in view of the above mentioned defects and, therefore, an object of the present invention is to provide a sheet ejector which is capable of stacking a plurality of sheets ejected from a sheet handling apparatus on a sheet tray in registered manner such that particular sides of the sheets of the stack are exactly aligned with each other.

The present invention which is means for achieving the above object is an ejector comprising a movable member movable between a wait position corresponding to a sheet ejecting port of a sheet handling apparatus and the sheet tray, a sheet pinching means mounted on the movable member for temporarily pinching a sheet ejected from the sheet handling apparatus and a sheet ejecting means mounted on the movable member for transporting the sheet temporarily pinched by the sheet pinching means, wherein the pinching means on the movable member in the wait position pinches the sheet ejected from the sheet handling apparatus, then the movable member moves to the sheet tray while the ejected sheet being kept pinched by the pinching means thereon, and, then, the sheet is ejected onto the sheet tray by the sheet ejecting means.

DETAILED DESCRIPTION OF THE PREFERRED EMBODIMENTS

Figure 1:
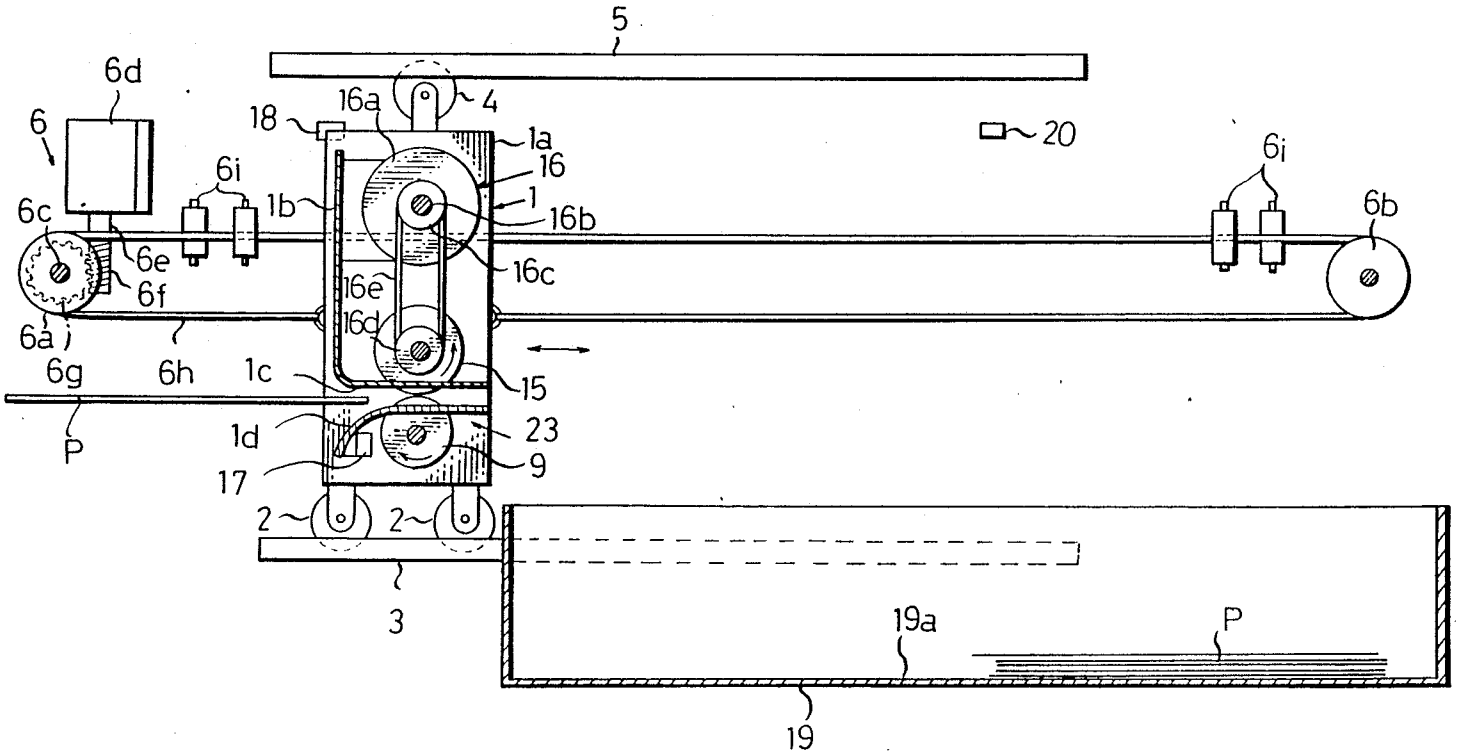
FIG. 1 is a cross section of an embodiment of a sheet ejector according to the present invention.

In FIG. 1, a reference numeral 1 depicts a movable member having rollers 2 by which it is supported movably along rails 3 in substantially horizontal directions. The movable member 1 is provided on an upper surface thereof with a guide roller 4 which is movable along a guide rail 5 extending horizontally.

The movable member 1 is driven horizontally within a predetermined distance by a driving device 6. The driving device 6 is composed of two pairs of pulleys 6*a* and 6*b*, a reversible stepping motor 6*d* arranged in the vicinity of a rotary shaft 6*c* of the pulleys 6*a*, a worm gear means 6*f* fixedly secured to a drive shaft 6*e* of the stepping motor 6*d*, a gear 6*g* which meshes with the worm gear 6*f* and is fixedly secured to the rotary shaft 6*c* of the pulley 6*a*, a wire 6*h* having one end fixed to one of opposing side plates 1*a* of the movable member 1 and the other end fixed to the other side plate 1*a* and stretched over the pulleys 6*a* and 6*b* and guide rollers 6*i* for guiding the wire 6*h*. The movable member 1 is further equipped with a holding plate 1*b* provided integrally with the side plate 1*a*. A sheet guide members 1*c* and 1*d* are arranged in the movable member 1, which form a guide path below the holding plate 1*b* for sheets P fed from a sheet handling apparatus such as electronic copying machine.

Figure 2:
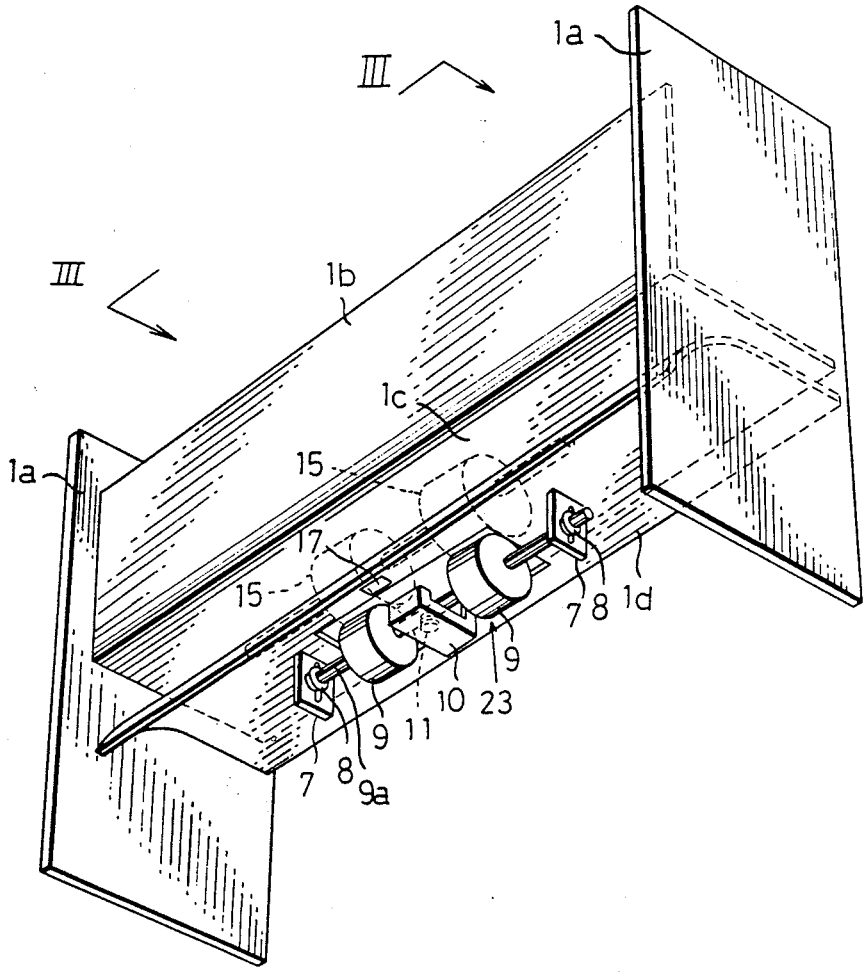
FIG. 2 is a perspective view of a movable member in the embodiment shown in FIG. 1.
Figure 3:
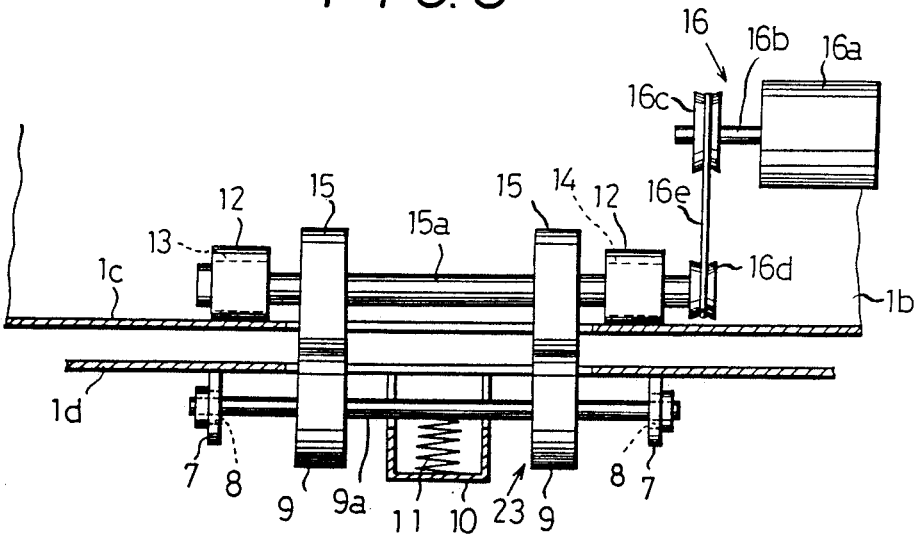
FIG. 3 is a partial cross section taken along a line III—III in FIG. 2.

As shown in FIGS. 2 and 3, a pair of holding members 7 protrude from the guide member 1*d*. A bearing 8 is supported by each holding member 7 such that it is shiftable vertically. The bearings 8 support a common rotary shaft 9*a* of sheet eject rollers 9. Thus, the rollers 9 can be shiftable substantially vertically. The guide member 1*d* supports a holding member 10 which, in turn, supports a spring 11 for biasing the rotary shaft 9*a* of the rollers 9 upwardly.

As shown in FIG. 3, a pair of support members 12 protrude upwardly from the guide member 1*c*. Each support member 12 mounts a unidirectional (one-way) clutch 13 and a bearing 14 supports a common rotary shaft 15*a* of sheet eject rollers 15. The rollers 15 are driven by a sheet eject roller driving device 16.

As will become apparent later, the eject rollers 9 and 15 function as a sheet pinching means for pinching the sheet P temporarily as well as a sheet eject means for transporting the pinched sheet rightwardly in FIG. 1 to a sheet tray 19.

The driving device 16 is composed of a motor 16*a* fixedly mounted on the holding plate 1*b* of the movable member 1, a pulley 16c fixedly mounted on a drive shaft 16b of the motor 16a, a pulley 16d fixedly mounted on the shaft 15a of the rollers 15 oppositely to the pulley 16c and a belt 16e adapted to run over the pulleys 16c and 16d. The one-way clutch 13 serves to prevent the rollers 15 from rotating in an opposite direction to a sheet ejecting direction while allowing rotation thereof in the latter direction.

In a side of the rollers 9 and 15 in which the sheet P is inserted, a sheet sensor 17 is arranged for sensing a presence of the sheet P. The sensor 17 comprises a photosensor fixedly supported by the guide member 1d. A wait position sensor 18 is provided in a suitable position to sense that the rollers 9 and 15 are positioned in a wait point at which they receive the sheet P.

The wait position sensor 18 comprises a photosensor which detects the side plate 1a of the movable member 1 becomes in a predetermined position to thereby detect the rollers 9 and 15 in the wait position.

In FIG. 1, a sheet tray 19 is disposed below the movable member 1, which has a horizontal sheet receiving plane 19a. A roller stop position sensor 20 is arranged in a predetermined position for sensing when the movable member 1 and hence the rollers 9 and 15 are positioned in a place corresponding to the sheet P of the smallest size being able to be received in the tray 19. The sensor 20 comprises a photosensor which detects the rollers 9 and 15 in the predetermined position by detecting when the side plate 1a of the movable member 1 reaches the predetermined position.

Figure 4:
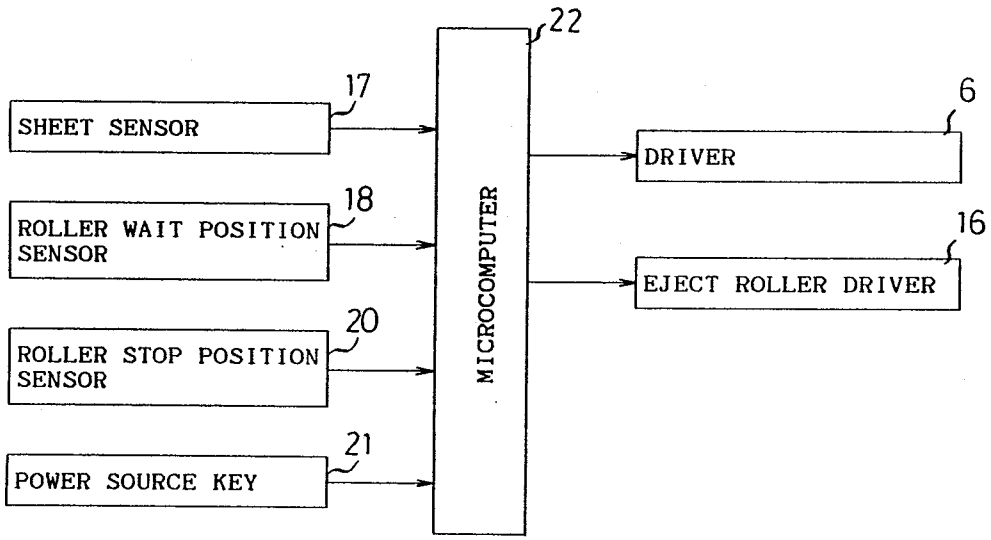
FIG. 4 is a block circuit diagram of an example of a control device.

A control device for controlling an operation of the ejector is shown in FIG. 4.

In FIG. 4, informations from the sheet sensor 17, the roller wait position sensor 18, the roller stop position sensor 20 and a power source key 21 etc. are received by an input port of a microcomputer 22. The microcomputer 22 includes an RAM having reciprocation flags etc. and an output port connected to the drive means 6 and the sheet eject roller drive device 16 etc.

Figure 5A:
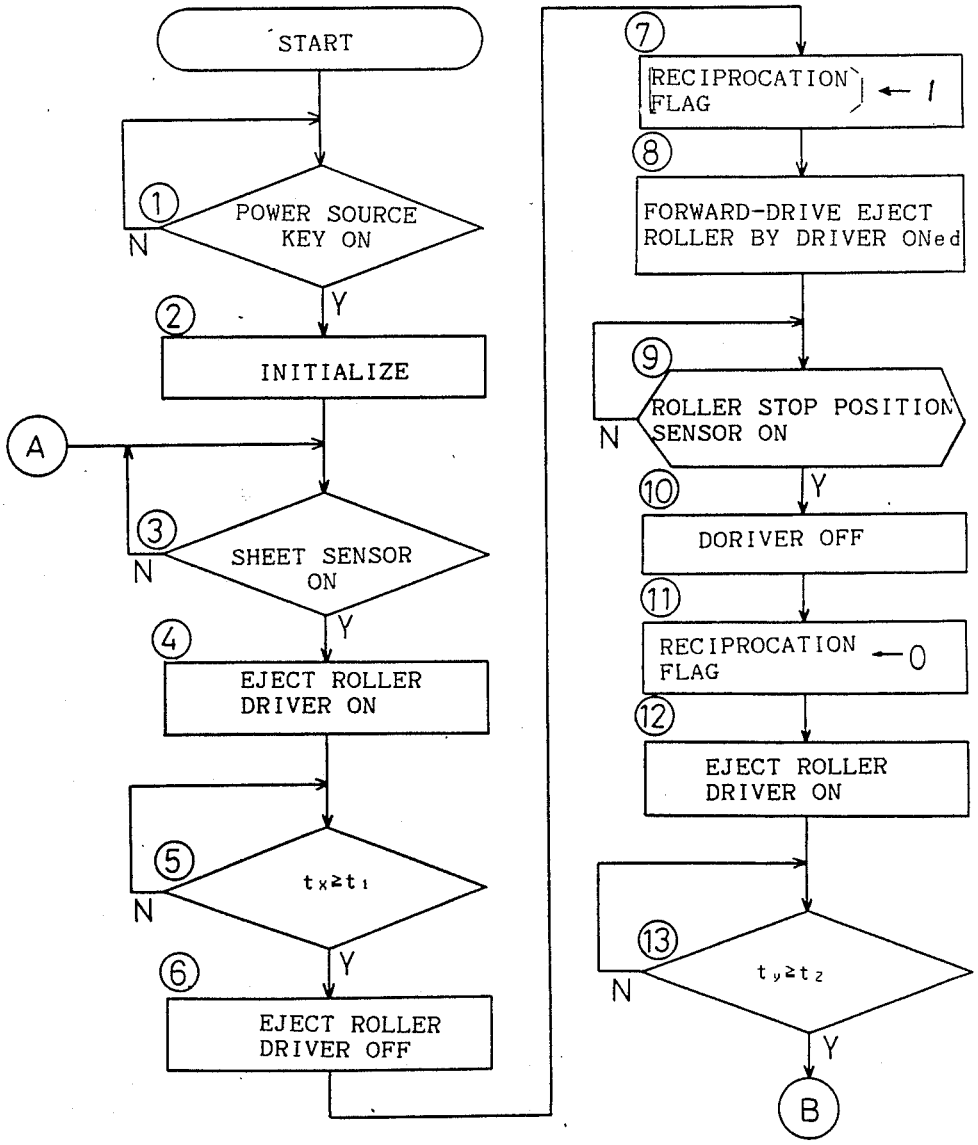
FIGS. 5*a* and 5*b* are flow-charts showing an example of control operation.
Figure 5B:
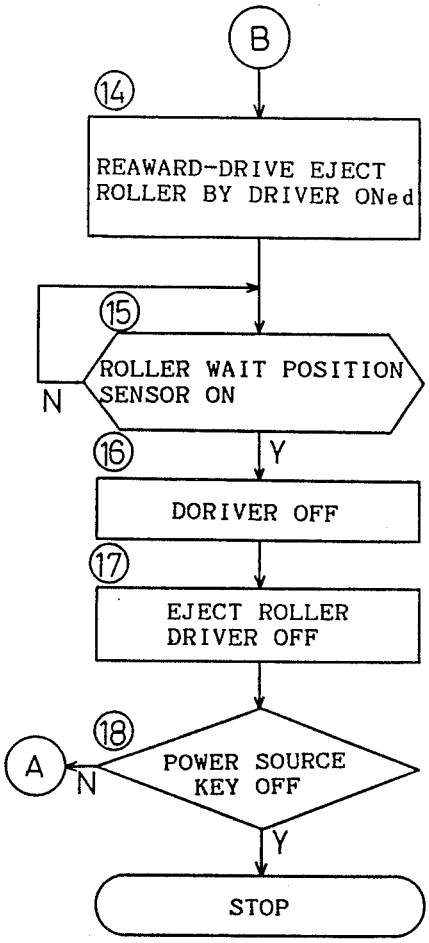

An operation of the sheet ejector will be described with reference to FIG. 5. The microcomputer 22 includes an ROM which stores a program shown by flowcharts in FIGS. 5a and 5b.

Firstly, it is checked in step 1 whether or not the power source key 21 is turned on. When the key 21 is turned on, the system is initialized in step 2. Upon the initialization, the RAM and the input and output ports of the microcomputer 22 are cleared.

Then, it is checked in step 3 whether or not the sheet sensor 17 is turned on. If yes, the roller drive device 16 is turned on in step 4 and, thereafter, $tx \geqq t_1$ is checked in step 5 where tx is a time from a time instance when the sheet sensor 17 is turned on and $t_1$ is a time period from a time instance at which the sheet sensor 17 is turned on to a time instance at which the rollers 9 and 15 pinch a front edge of the sheet P.

If an answer of the check in step 5 is yes, the roller drive means 16 is turned off in step 6, the reciprocation flag is made 1 in step 7, the drive means 6 is turned on in step 8 to move the rollers 9 and 15 and hence the movable member 1 forwardly and then it is checked in step 9 whether or not the roller stop position sensor 20 is on. If the check in step 9 is affirmative, the drive means 6 is turned off in step 10, the reciprocation flag is made 0 in step 11, the roller drive device 16 is turned on in step 12 and then $t_y \geqq t_2$ is checked in step 13, where $t_y$ is a time measured from a time instance at which the roller drive device 16 is turned on and $t_2$ is a time period from a time instance at which the roller drive device 16 is turned on to a time instance at which the minimum sized sheet P to be received on the tray 19 is ejected by the rollers 9 and 15.

If the answer in step 13 is yes, the drive means 6 is turned on in step 14 to move the eject rollers 9 and 15 (movable member 1) rearwardly. The movable member 1 moves rearwardly while discharging the sheet P. And then it is checked in step 15 whether or not the wait position sensor 18 is on. If yes, the drive means 6 is turned off in step 16 and, after the drive means 16 is turned off in step 17, it is checked in step 18 whether or not the power switch 21 is turned off. If the answer is no, the operation is returned to step 3 and, if yes, the operation is stopped.

Figure 6:
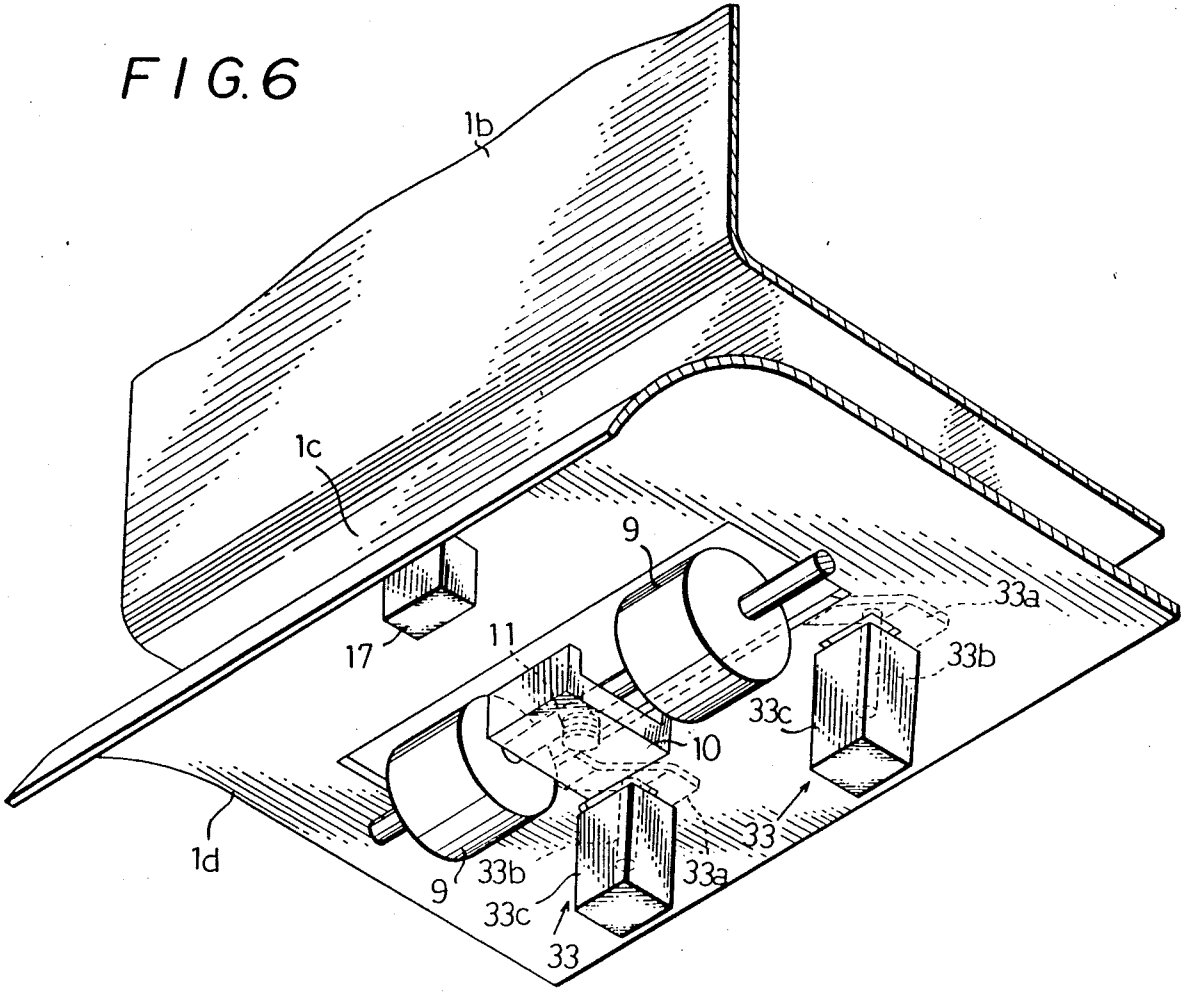
FIG. 6 is a perspective view of a sheet pinching means.

In the above embodiment; the roller 9 and 15 of the sheet pinching device 23 pinch the front edge of the sheet P, where the rollers 9 and 15 are reciprocated. However, it is possible to provide a sheet pinching device 33 which functions to temporarily pinch the front edge of the sheet to be inserted into between the rollers 9 and 15 separately therefrom, as shown in FIG. 6. The pinching device 33 comprises a pair of resilient pinching pieces 33a fixedly mounted on an upper surface of the paper guide member 1d and easily deformable and a pair of solenoids 33c fixedly mounted on a lower surface of the member 1d and having actuators 33b for shifting the pinching pieces 33a upwardly through holes in the guide member 1d.

The pinching pieces 33a are spaced apart from the guide member 1c, when the solenoids 33c are not actuated, so that they are not obstacle against the movement of the sheet P. When the solenoids 33c are actuated at a time when the front edge of the sheet P pinched between the rollers 9 and 15 reaches in between the pinching pieces 33a and the guide member 1c, the actuators 33b lift the pinching pieces 33a up, so that the pieces 33a urge the sheet P against the guide member 1c to pinch the sheet therebetween.

If the above embodiment, the movable member 1 is stopped at predetermined position on the basis of a signal derived from the roller stop position sensor 20. It is possible, however, to stop the movable member 1 when a time measuring means, such as a counter, included in the microcomputer 22 counts a predetermined period of time from a time instance at which the movable member 1 leaves from the wait position sensor 18. As a result, the roller stop position sensor 20 may be eliminated.

Figure 7:
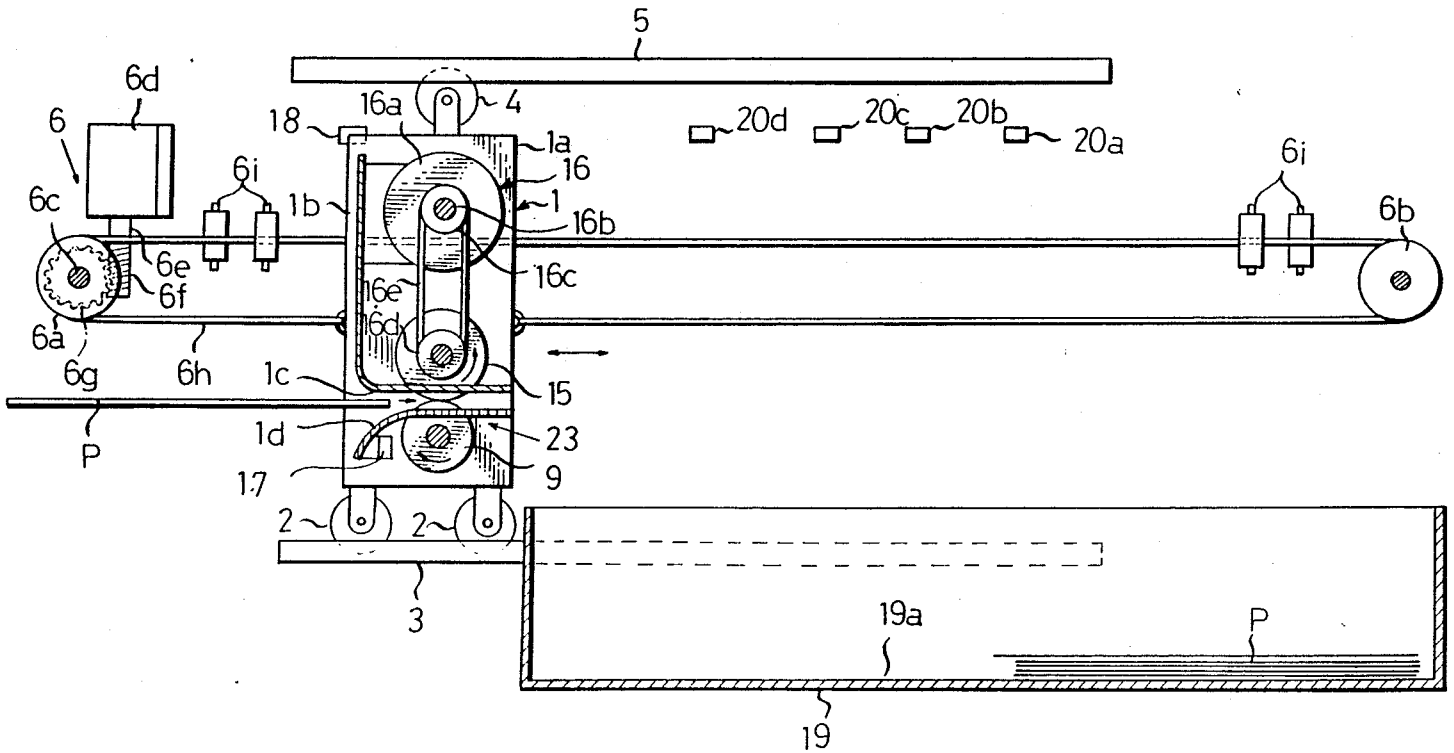
FIG. 7 is a cross sectional view showing another embodiment of the sheet ejector according to the present invention.

FIG. 7 shows another embodiment. In FIG. 7, the same reference numerals as those in FIG. 1 depict the same components as those in FIG. 1, respectively. The embodiment in FIG. 7 is different from that in FIG. 1 in that, instead of the roller stop position sensor 20, four roller stop position sensors 20a, 20b, 20c and 20d are arranged correspondingly to sizes of the paper sheet P to be stored in the eject sheet tray 19. Each of these sensors comprises a photosensor and functions to detect that the rollers 9 and 15 are positioned in the predetermined locations by sensing the movable member 1 in the predetermined position.

Figure 8:
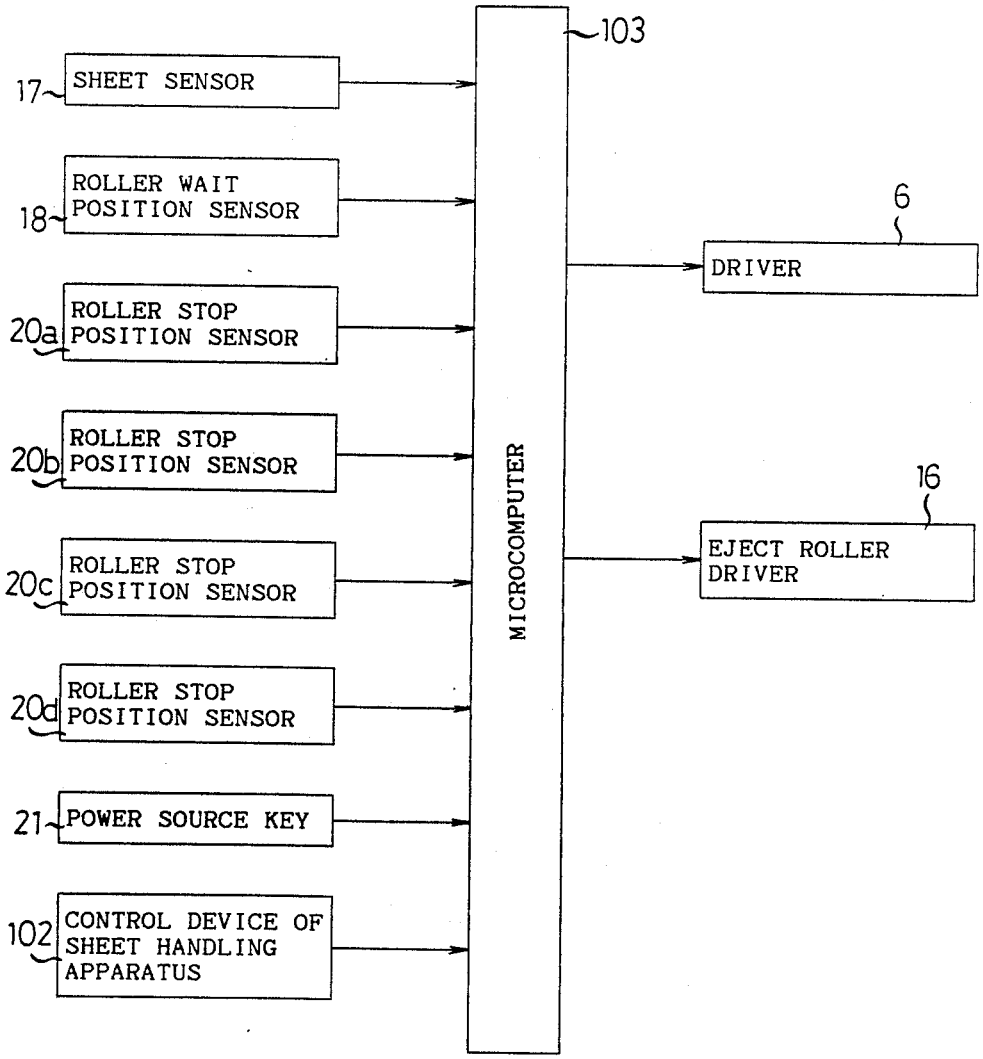
FIG. 8 is a block circuit diagram of another example of the control device.

FIG. 8 shows a control device which differs from that shown in FIG. 4 in that informations from to sensors 20a to 20d and sheet size information from the control device 102 of the sheet handling apparatus are inputted to a microcomputer 103. An RAM of the microcomputer 103 contains informations from a paper size counter and a roller stop position counter in addition to the reciprocation flags.

Figure 9A:
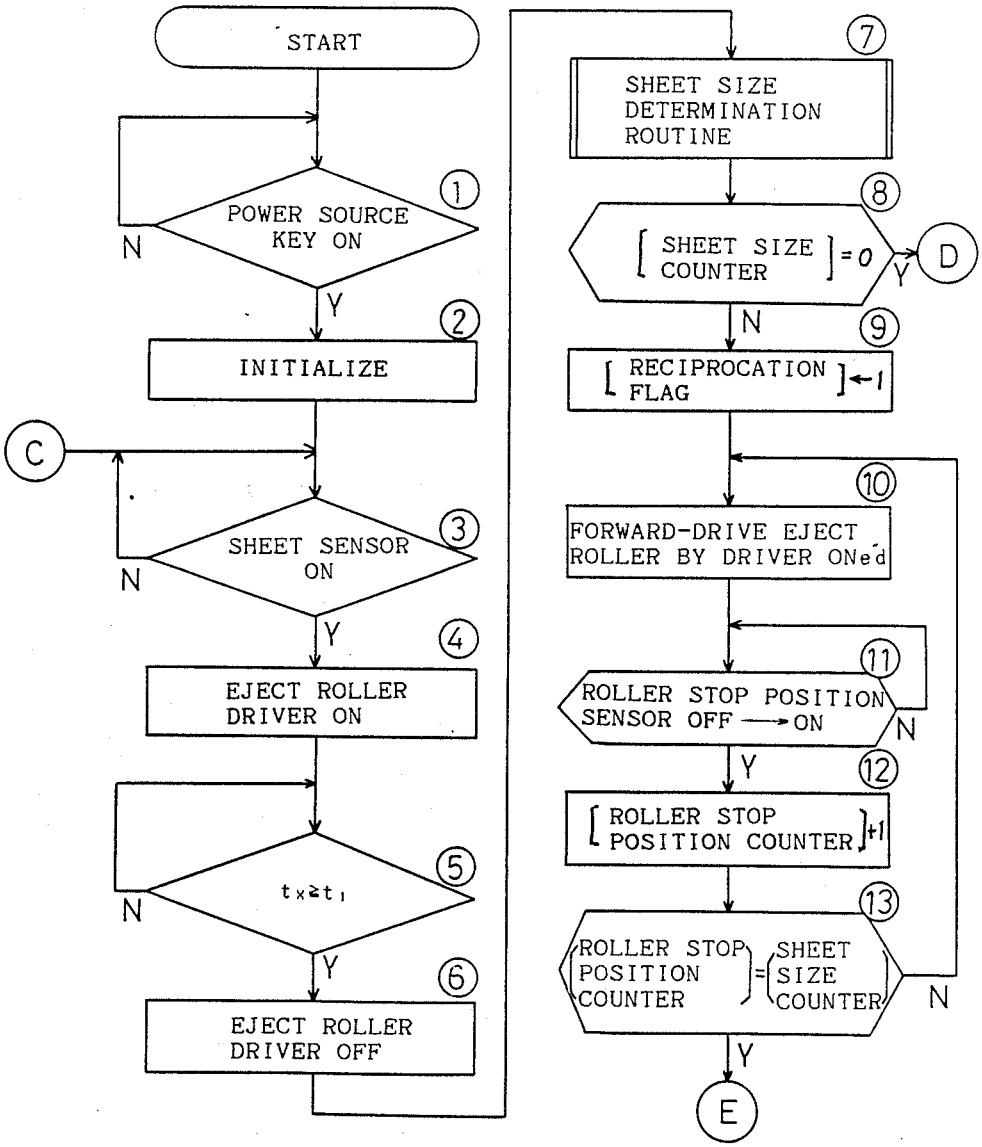
FIGS. 9*a*, 9*b* and 10 are flow-charts showing another example of control operation.
Figure 9B:
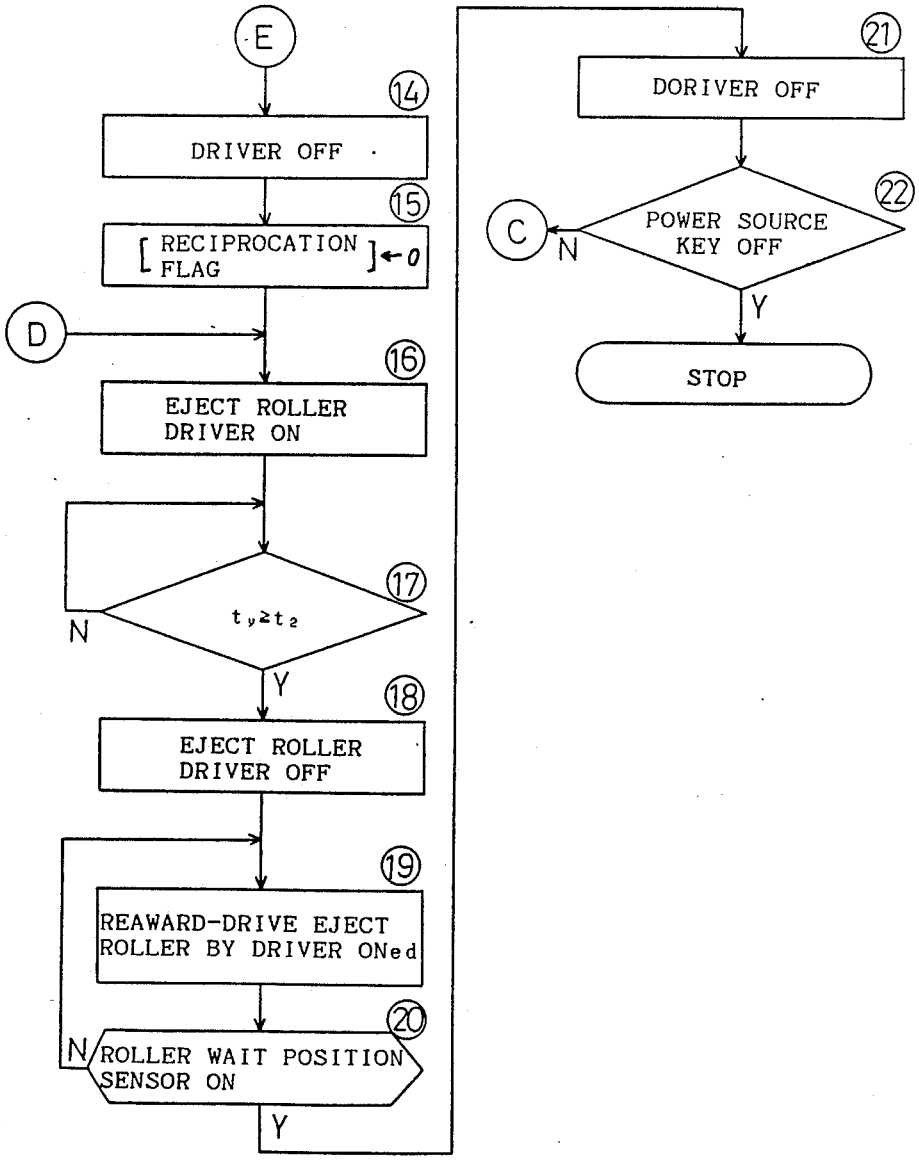
Figure 10:
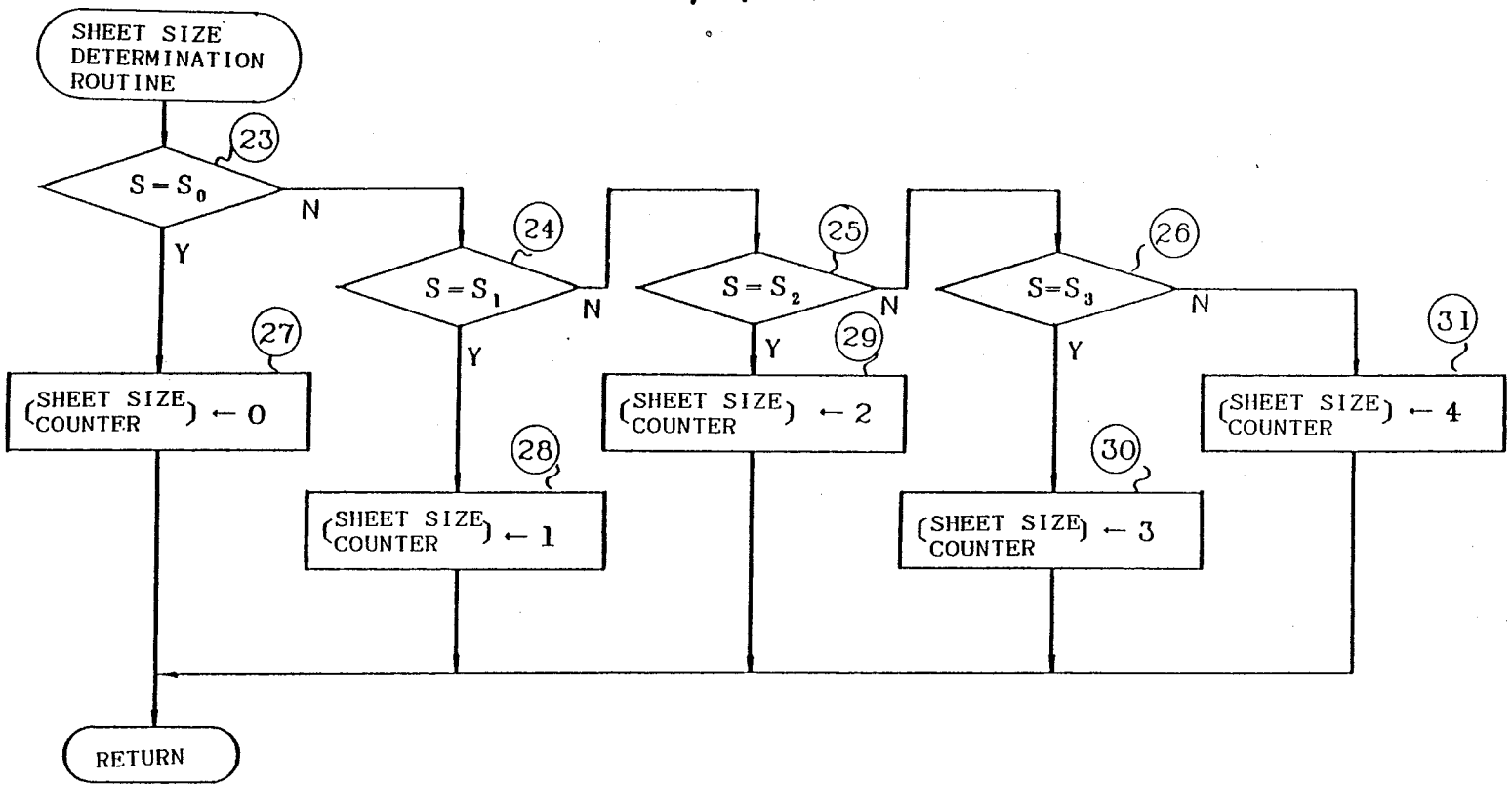

The microcomputer 103 performs controls such as shown by flow-charts in FIGS. 9a, 9b and 10. Steps 1 to 4 in FIG. 9 are the same as those in FIG. 5. When the answer in step 5 is yes, the eject roller drive device 16 is turned off in step 6 and, after a sheet size judge routine in step 7, it is checked in step 8 whether of not [sheet size counter]=0. If the answer is no, [reciprocation flag] is made 1 in step 9 and the drive device 6 is turned on in step 10 to move the rollers 9 and 15 forwardly and simultaneously it is checked in step 11 whether or not the sensors 20a to 20d are turned on. If the answer is yes, [roller stop position counter]+1 is performed in step 12 and then it is checked in step 13 whether or not [roller stop position counter]=[sheet size counter].

If the answer of the check in step 13 is no, the operation is returned to step 10 to hold the drive device 6 on. If the answer is yes, the drive device 6 is turned off in step 14 and [reciprocation flag] is made 0 in step 15 and, after the drive device 16 is turned on in step 16, it is checked whether $t_y \geqq t_2$ in step 17. $t_y$ is a time from a time instance at which the eject roller drive device 16 is turned on in step 16 and $t_2$ is a time period from that time instance to a time instance at which the sheet of the maximum size to be stored in the tray 19 is ejected by the rollers 9 and 15.

When [sheet size counter]=0 is decided in step 8, i.e., when the size of the sheet P to be ejected is the largest, there is no need of moving the rollers 9 and 15 forwardly. Therefore, the operation is jumped to step 16 to turn the drive device 16 on to thereby eject the sheet P.

When it is decided $t_y \geqq t_2$ in step 17, the roller drive device 16 is turned off in step 18 and the drive device 6 is turned on in step 19 to move the rollers 9 and 15 rearwardly, and then it is checked in step 20 whether or not the roller wait position sensor 18 is turned on. If negative, the operation is returned to step 19 to hold the drive device 6 on and if affirmative, the drive device 6 is turned off in step 21 and then it is checked in step 22 whether the power switch key 21 is turned off.

When the answer is no, the operation is returned to step 3 and, if yes, the operation is stopped.

The sheet size determination routine to be performed in step 7 will be described with reference to FIG. 10.

The size S of the sheet P fed from the control device of the sheet handling apparatus is checked in steps 23 to 26 whether or not $S=S_0$, $S_1$, $S_2$, $S_3$ and $S_4$, respectively, where $S_0>S_1>S_2>S_3>S_4$. When it is decided in steps 23 to 26 that $S=S_0$, $S_1$, $S_2$, $S_3$ or $S_4$, [sheet size counter] is loaded with 0, 1, 2, 3 or 4 and then the operation is returned to the main routine.

Since according to the embodiment in FIG. 7, the sheet is ejected by the eject rollers 9 and 15 after the latter rollers are moved forwardly to a location corresponding to the size of the ejected sheet, it is possible to stack the sheets on the tray 19 in registration with each other even if the size of them is various. Particularly, it is possible to register the front edges (right end in FIG. 7) thereof.

Figure 11:
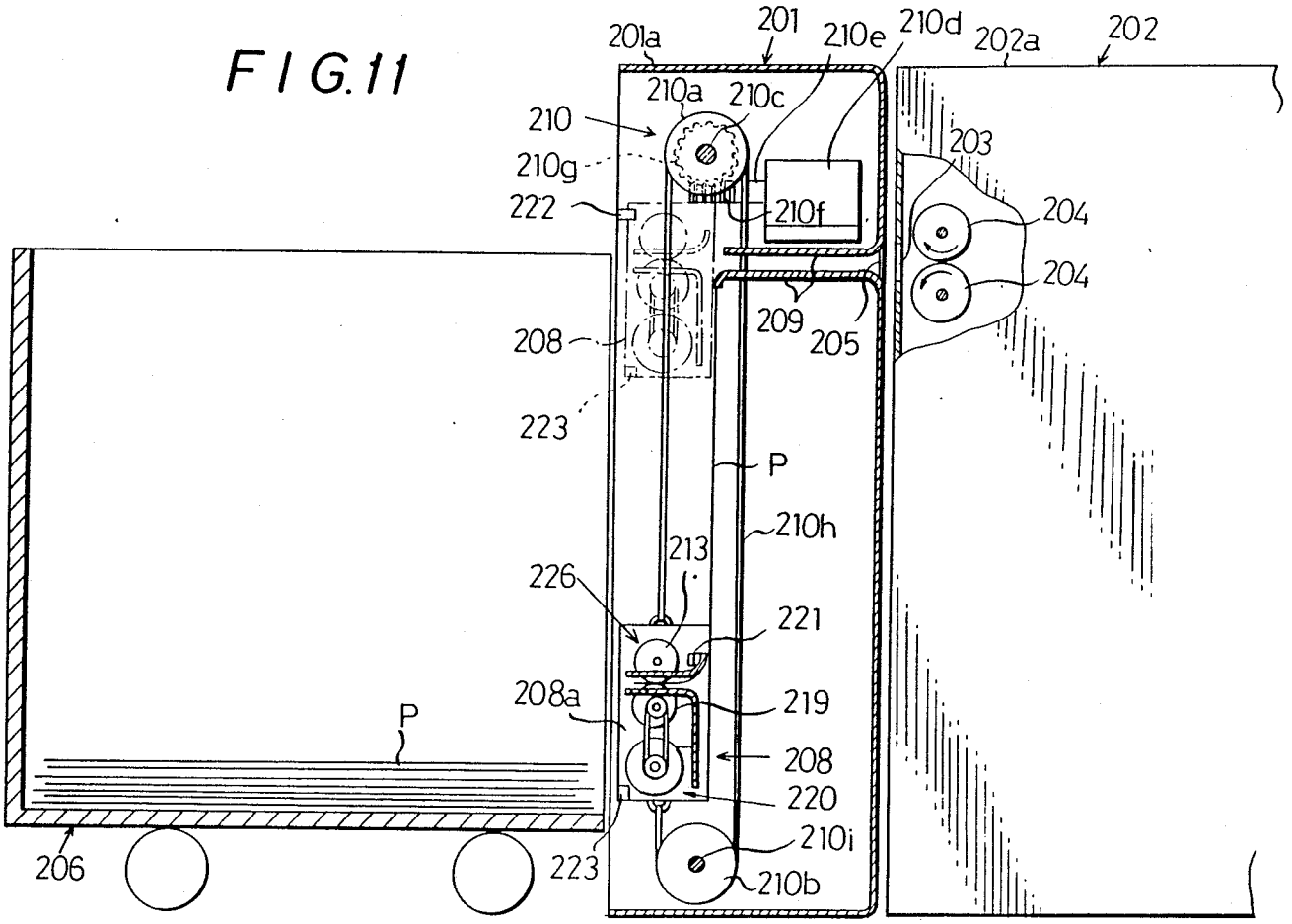
FIG. 11 is a cross section of another embodiment of the sheet ejector according to the present invention.
Figure 12:
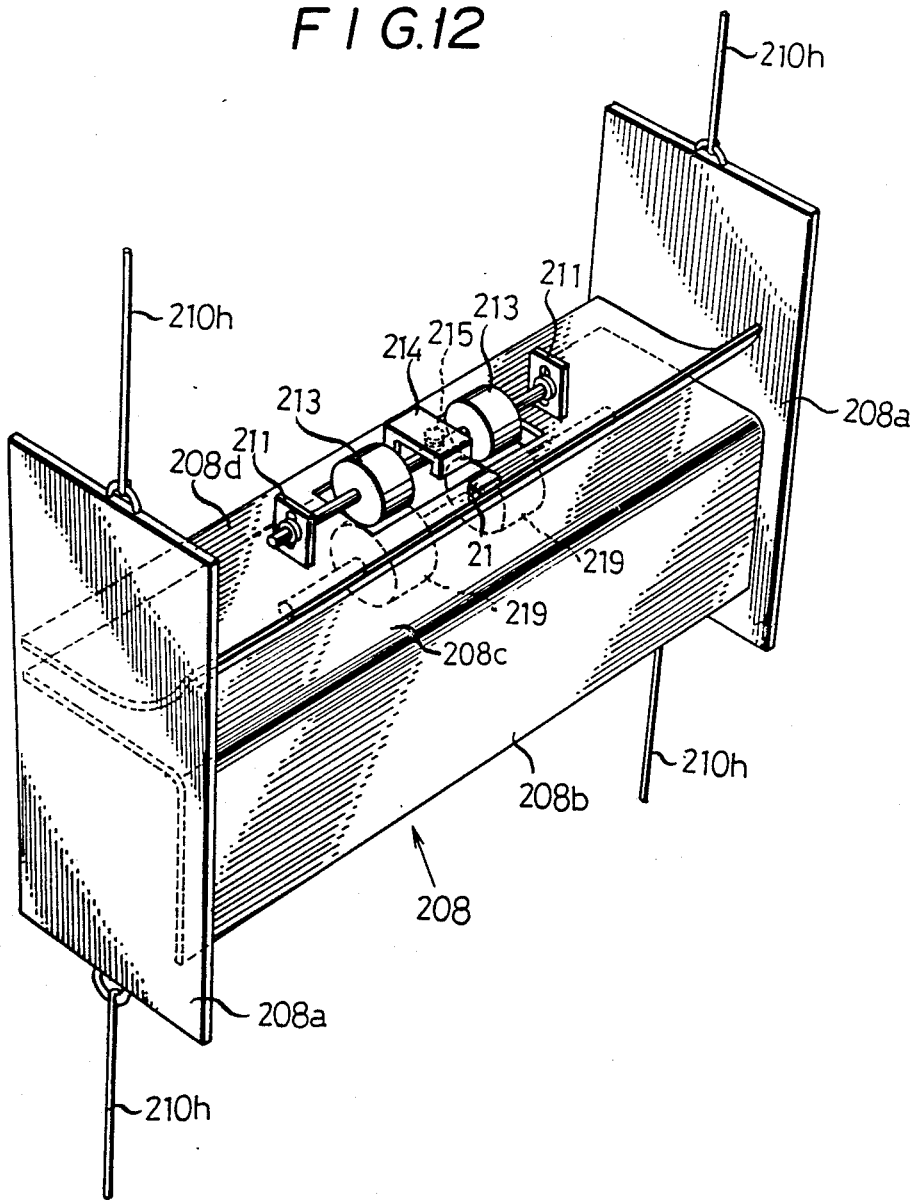
FIG. 12 is a perspective view of a movable member in the embodiment in FIG. 11.
Figure 13:
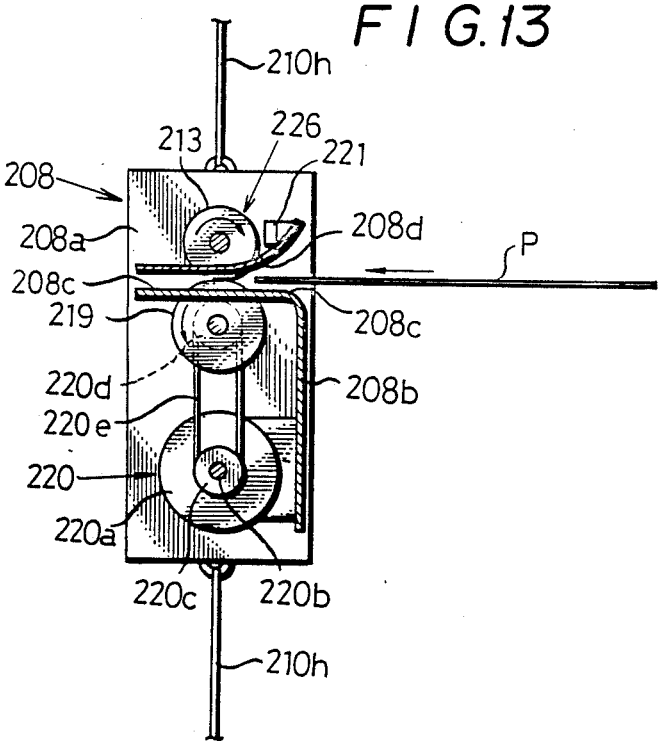
FIG. 13 is a cross section of the movable member in FIG. 12.

FIG. 11 shows another embodiment. A sheet eject apparatus according to this embodiment is featured by capabilities of ejecting a large member of sheets onto the tray in registration relationship.

In FIG. 11, a reference numeral 201 depicts the sheet eject apparatus. An electronic copying machine 202 which is one of the sheet handling apparatus is located adjacent an outer plate 201a of the sheet eject apparatus 201. An ejecting port 203 is formed in an outer plate 202a of the machine 202 on the side of the eject apparatus 201, through which the sheet P is discharged. A pair of eject rollers 204 are arranged within the outer plate 202a adjacent the eject port 203.

A sheet receiving port 205 is formed in the outer plate 201a of the eject apparatus 201 opposing to the eject port 203.

An eject sheet tray 206 for storing the sheets in stack is disposed in an opposite side of the outer plate 201a to the machine 202.

In the outer plate 201a, a vertically movable member 208 is arranged in the vicinity of the tray 206. A sheet guide 209 for guiding the sheets P is disposed between the eject roller 204 and the movable member 208. The latter member is moved vertically by an elevation device 210. The latter device comprises two pairs of pulleys 210a, 210b, a reversible stepping motor 210d arranged in the vicinity of a rotary shaft 210c of the upper pulley pair 210a, a worm gear 210f fixedly mounted on a drive shaft 210e of the stepping motor 210d, a gear 210g fixedly mounted on the shaft 210c and meshed with the worm gear 210f, and a pair of wires 210h extending over the pulley pairs 210a and 210b and having opposite ends connected to an upper and lower surfaces of the movable member 208.

Opposite ends of each of the shafts 210c and 210i of the pulley pairs 210a and 210b are supported by bearings fixedly mounted on the outer plate 201a, respectively. The stepping motor 210d is also fixedly mounted on the outer plate 201a.

The movable member 208 comprises side plates 208a and a holding plate 208b fixedly integrally therewith. A pair of sheet guide members 208c and 208d for guiding sheets P from eject rollers 204 are arranged on the side plates 208a and the holding plate 208b.

Figure 14:
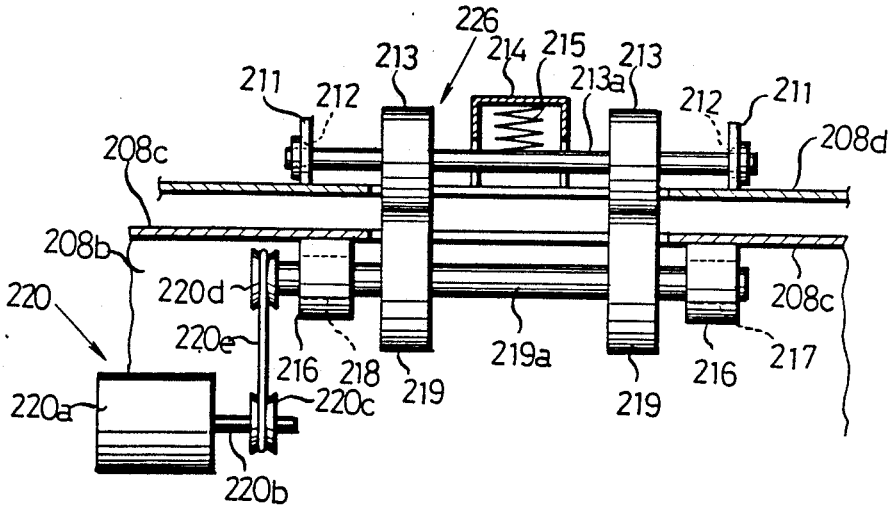
FIG. 14 is a front view of the movable member in FIG. 12.

As shown in FIG. 14, two support members 211 protrude from the guide member 208d. The support members 211 are formed with vertical slots in which bearings 212 are received allowing slight vertical movements, respectively. The bearings 212 support a rotary shaft 213a of an eject roller 213. A holding member 214 also protrudes from the guide member 208d, by which a spring 215 for biasing the shaft 213a downwardly is supported.

Two support members 216 protrude downwardly from the guide member 208c which are provided with one-way clutches 217 and bearings 218, respectively. A rotary shaft 219a of eject rollers 219 are supported by the clutches 217 and the bearings 218. The eject rollers 219 are drived by an eject roller drive device 220 which comprises a motor 220a fixedly mounted on the holding plate 208b of the movable member 208, a pulley 220c fixed on a drive shaft 220c of the motor 220a, a pulley 220d fixed in facing relation to the pulley 220c on the rotary shaft 219a of the eject roller 219 and a belt 220e extending over the pulley 220c and 220d. The one-way clutch 217 functions to allow the roller 219 to rotate in sheet feeding direction toward a tray 206 while preventing a reverse rotation.

A sheet sensor 221 is arranged in the vicinity of the rollers 213 and 219 and between the rollers 213, 219 and the rollers 204 for sensing the sheet P. The sensor comprises a photosensor mounted fixedly on the guide member 208d. A roller wait position sensor 222 is arranged suitably for sensing that the rollers 213, 219 are positioned in the wait position in which the sheet P from the rollers 204 are received. The sensor 222 comprises a photosensor and functions to detect the rollers 213, 219 in the wait position by detecting the side plate 208*a* of the movable member 208 in a predetermined position. A sheet position sensor 223 is fixed on a lower portion of the movable member 208 for sensing a position of the uppermost sheet P on the tray 206. The sensor 223 is a photosensor.

The sheet P fed from the eject rollers 204 is guided by the sheet guide member 209 into between the eject rollers 213 and 219 which are in the wait positions shown by chain lines without rotation. When the sensor 221 detects the front edge of the sheet P, the rollers 213 and 219 are rotated in the sheet feeding direction to the tray 206 for a short, predetermined time to pinch the front edge.

At the time when the rollers 213, 219 pinch the sheet P therebetween, the movable member 208 and the rollers 213, 219 are lowered up to a level above the uppermost sheet P by a predetermined distance. Since, during the lowering motion of them, the roller 219 is prohibited by the one-way clutches 217 to rotate in reverse direction, the sheet P does never escape from the rollers 213 and 219. The lowering velocity of the rollers 213 and 219 is set as substantially the same as the feeding speed of the sheet P from the rollers 204 of the copying machine 202.

At a time when the lowering motion of the rollers 213 and 219 is stopped, the rollers start to rotate to discharge the sheet P to the tray 206, and the rotations of them continue until a short, predetermined time period from the time instance at which the sensor 221 detects a trailing edge of the sheet P lapses. Then, the rollers are stopped to rotate and lifted up, together with the movable member 208, to the wait position. This upward movement is performed at a speed which may be higher than the feeding speed of the sheet P from the rollers 204 since the rollers 213 and 219 does not pinch any sheet therebetween.

Figure 15:
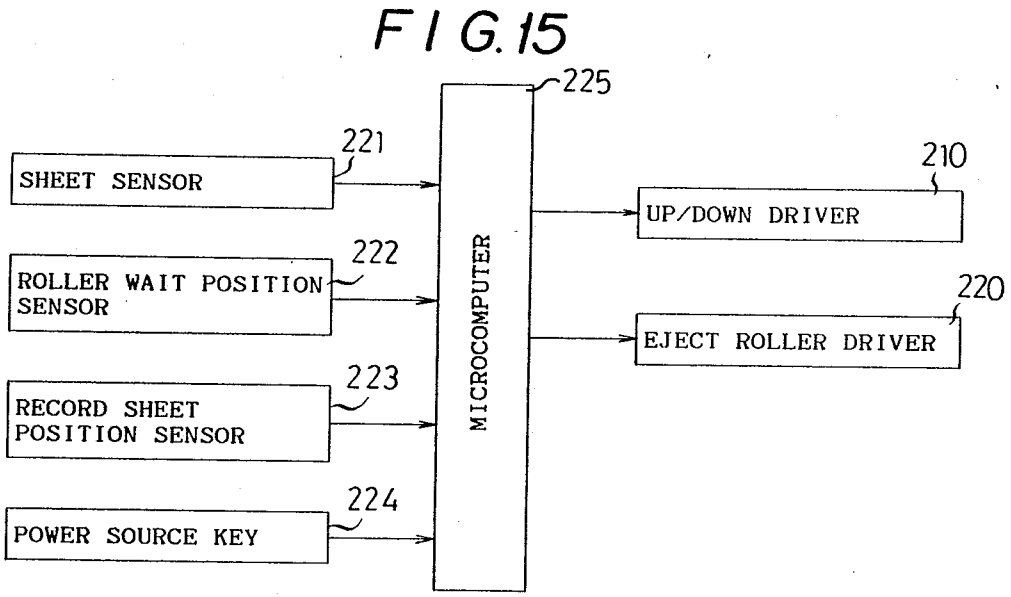
FIG. 15 is a block diagram of another example of the control device.

The control device for the above sheet ejector is shown in FIG. 15.

Informations from the sheet sensor 221, the roller wait position sensor 222, the copy sheet position sensor 223 and an operation display panel which is not shown are supplied to a microcomputer 225. An RAM of the microcomputer 225 contains an up/down flag. The microcomputer 225 has an output port to which the vertical drive device 210 and the eject roller drive device 220 are connected.

The operation of the above mentioned sheet ejector will be described in detail with reference to FIGS. 16*a* and 16*b*.

Figure 16A:
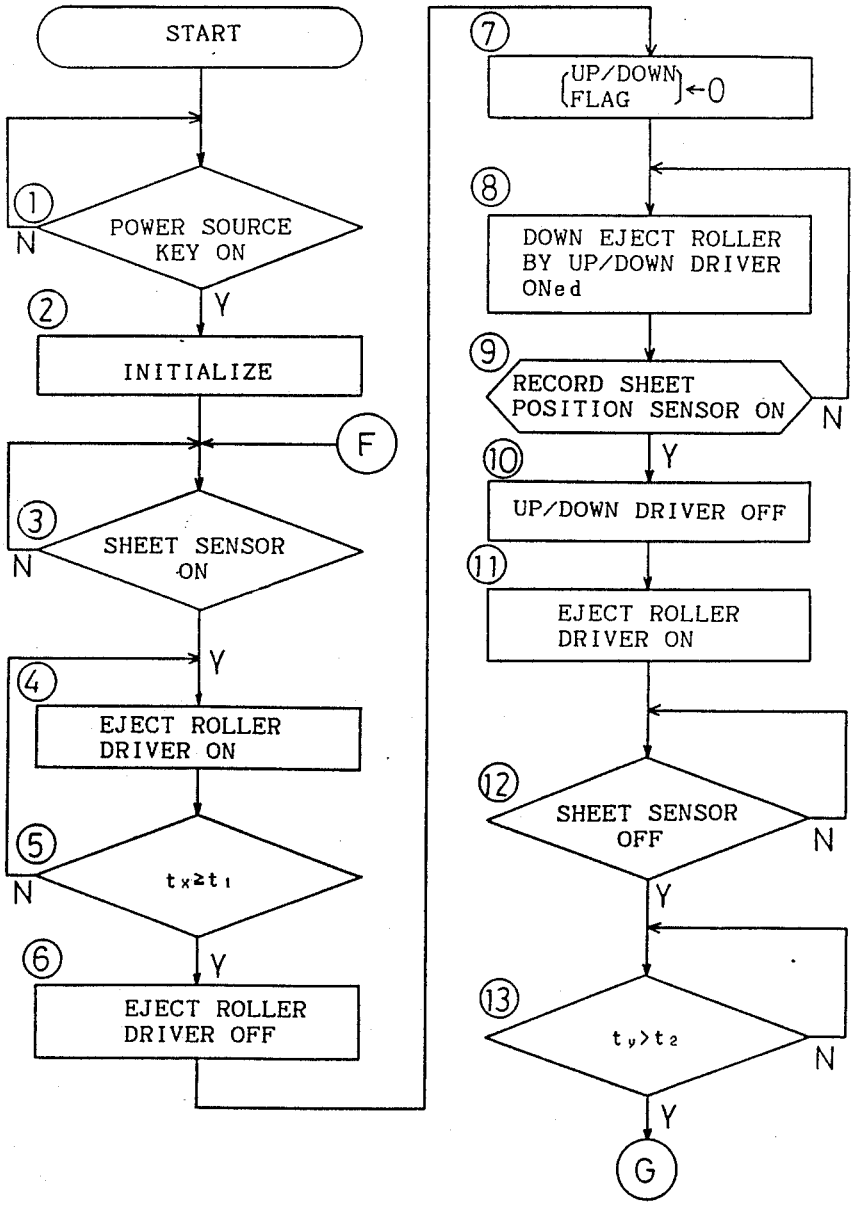
FIGS. 16*a* and 16*b* are flow-charts showing another example of control operation.
Figure 16B:
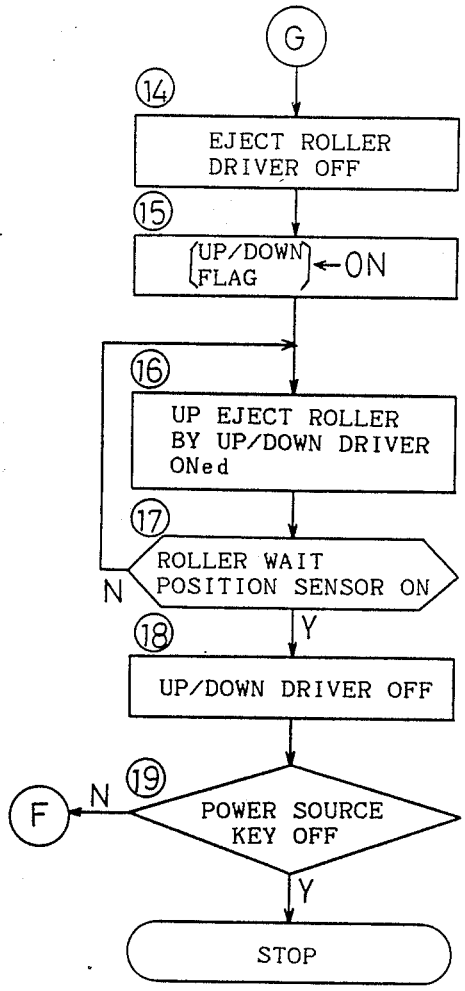

An ROM of the microcomputer 225 stores programs shown by flow-charts in FIGS. 16*a* and 16*b*.

Firstly, it is checked in step 1 whether or not a power key switch 224 is on. If yes, an initialization is performed in step 2, upon which the RAM and the input and output ports of the microcomputer 225 are cleared.

Then, it is checked in step 3 whether or not the sheet sensor 221 is on. If yes, the eject roller drive device 220 is turned on in step 4 and then whether or not $t_x \geqq t_1$ is checked in step 5, where $t_x$ is a time from a time instance at which the sensor 221 is turned on and $t_1$ is a time period from that time instance to a time at which the rollers 213 and 219 pinch the front edge of the sheet. If $t_x < t_1$, the operation is returned to step 4 to keep the roller drive device 220 on. If $t_x \geqq t_1$, the roller driver 220 is turned off in step 6 and [up/down flag] is made 0 in step 8 to turn the up/down driver 210 on to thereby lower the rollers 213 and 219. Then it is checked in step 9 whether or not the copy sheet position sensor 223 is turned on. If negative, the operation is returned to step 8 to keep the up/down driver 210 on.

If affirmative, the up/down driver 210 is turned off in step 10 and the roller driver 220 is turned on in step 11. Then, it is checked in step 12 whether or not the sensor 221 is turned off.

When the answer in step 12 is affirmative, it is checked in step 13 whether or not $t_y \geqq t_2$, where $t_y$ is a time from a time instance at which it is decided in step 12 that the sensor 221 is off and $t_2$ is a time period from that time instance to a time at which the sheet P is ejected from the rollers 213 and 219.

If the answer in step 13 is affirmative, the roller driver 220 is turned off in step 14, [up/down flag] is made 1 in step 15 and the up/down driver 210 is turned on in step 16 to lift the rollers 213 and 219 up, and then it is checked in step 17 whether or not the wait position sensor 222 is on. If negative, the operation is returned to step 16 to keep the up/down driver 210 on. On the other hand, if affirmative, the up/down driver 210 is turned off in step 18 and then it is checked in step 19 whether or not the power key switch 224 is turned on. If negative, the operation is returned to step 3 and if affirmative, the operation is stopped.

Figure 17:
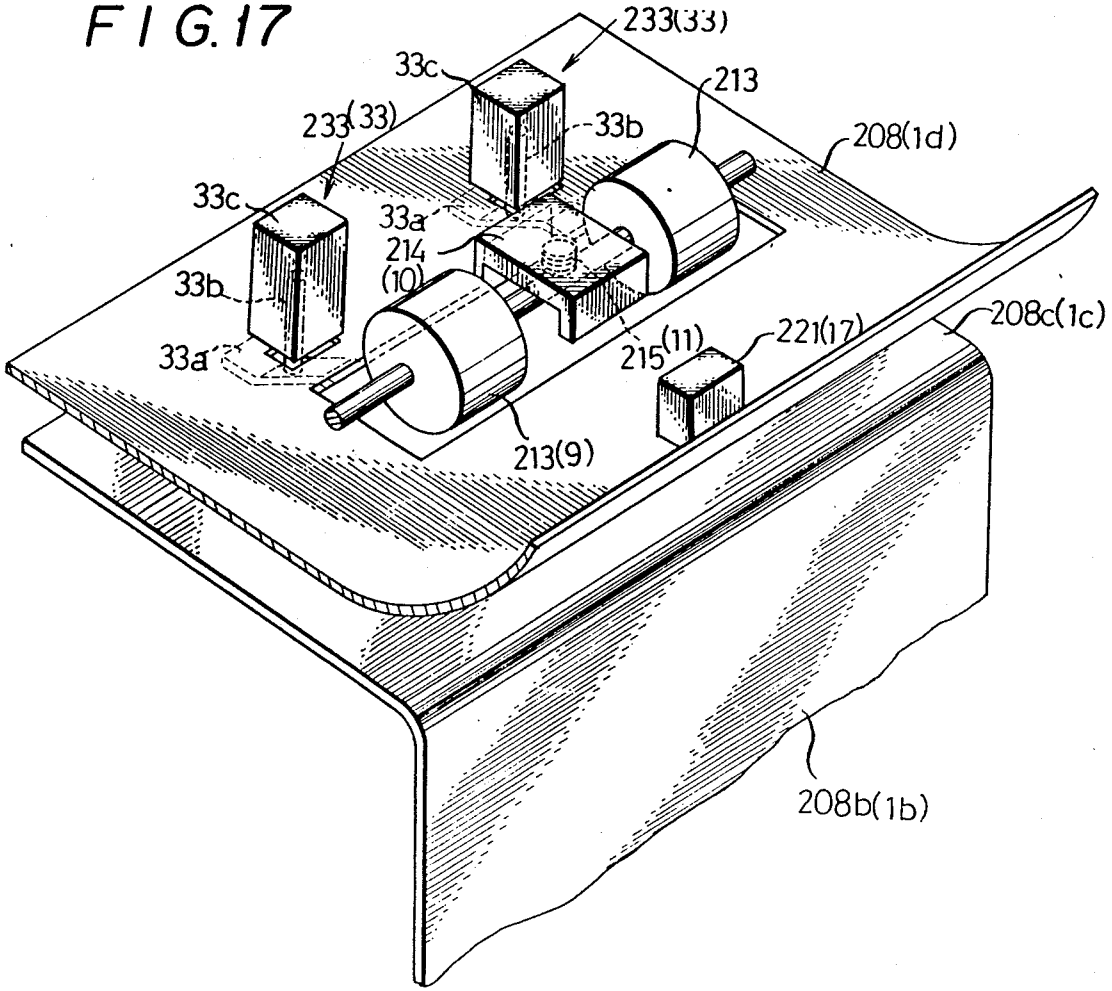
FIG. 17 is a perspective view of another example of the sheet pinching means.

In the above described embodiment, the sheet pinching means 226 is constituted with the eject rollers 213 and 219. However, it may be substituted by the sheet pinching device 233 shown in FIG. 17. The device 233 is the device 33 shown in FIG. 6 upside down and therefore details thereof are not described here. Parenthesized reference numerals in FIG. 17 show the corresponding portions in FIG. 6, respectively.

What is claimed is:

1. A sheet ejector for transporting sheets discharged from a sheet handling apparatus to a sheet tray having a sheet receiving plane arranged substantially horizontally comprising:

a movable member vertically movable from a wait position corresponding to a sheet discharge port of said sheet handling apparatus toward said sheet receiving plane of said sheet tray;

a pair of rollers, a drive device for said rollers and stopping means for said rollers which are disposed on said movable member for holding a sheet discharged from said sheet handling apparatus and for discharging the sheet to said sheet tray by rotating;

means for discharging sheets from said sheet handling apparatus so that said discharged sheet is held by said pair of rollers on said movable member positioned in said wait position;

means for transporting said movable member to a position in which said pair of rollers are located above an uppermost sheet of sheets stacked on said sheet tray while holding the sheets by said pair of rollers; and means for rotating said pair of rollers to discharge the sheet.

2. A sheet ejector as claimed in claim 1, further comprising:

a sheet position sensor disposed on said movable member for detecting said uppermost sheet.

3. A sheet ejector as claimed in claim 1, further comprising:

a one-way clutch means for permitting said rollers to rotate only in such a direction as to discharge a sheet to said sheet tray.

4. A sheet ejector as claimed in claim 1, further comprising:

a sheet sensor for detecting a front edge of a sheet to determine a period of time of rotating of said rollers for holding the sheet, and for detecting a trailing edge of the sheet to determine a period of time of rotation of said rollers for discharging the sheet.

5. A sheet ejector as claimed in claim 1, in which said stopping means for preventing of withdrawing of said sheet comprising a one way clutch, a spring for pressing said pinch rollers toward each other and a means for stopping said motor.

* * * * *